United States Patent [19]

Van Auken et al.

[11] 4,212,310

[45] * Jul. 15, 1980

[54] UNITARY PACK OF SMOKING TOBACCO PRODUCTS CONTAINING POLYMERIC ALCOHOL FLAVORANT-RELEASE COMPOSITIONS

[75] Inventors: Thomas V. Van Auken, Richmond; Harvey J. Grubbs, Mechanicsville; William R. Johnson, Jr., Richmond, all of Va.

[73] Assignee: Philip Morris Incorporated, New York, N.Y.

[ * ] Notice: The portion of the term of this patent subsequent to Oct. 10, 1995, has been disclaimed.

[21] Appl. No.: 859,712

[22] Filed: Dec. 12, 1977

[51] Int. Cl.[2] ..... A24B 3/14; A24B 3/12

[52] U.S. Cl. ..... 131/17 R; 131/144

[58] Field of Search ..... 131/17, 144; 229/44 CB

[56] References Cited

U.S. PATENT DOCUMENTS

| | | | |
|---|---|---|---|
| 3,039,671 | 6/1962 | Chiamardas | 229/44 CB |
| 4,119,106 | 10/1978 | Van Auken et al. | 131/17 R |

*Primary Examiner*—William E. Kamm
*Assistant Examiner*—Thomas J. Wallen
*Attorney, Agent, or Firm*—Watson, Leavenworth, Kelton & Taggart

[57] ABSTRACT

A unitary pack of smoking tobacco products is provided in which a flavorant is incorporated in some of the smoking tobacco products in the form of a polymeric alcohol flavorant-release composition which has the general formula:

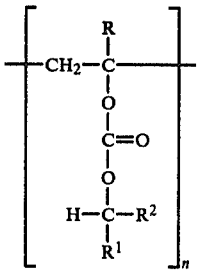

wherein R is selected from aliphatic, alicyclic, heterocyclic and aromatic hydrocarbon radicals; $R^1$ and $R^2$ are selected from hydrogen and aliphatic, alicyclic, heterocyclic and aromatic hydrocarbon radicals; and n is an integer. These polymers release a flavorant when heated. Such polymers include polymers formed from α-substituted vinyl menthyl carbonate esters, such as poly(α-methylvinyl α-menthyl carbonate) and poly(α-styryl α-menthyl carbonate), which release menthol when heated. Smoking tobacco products which are made with tobacco which has been treated with a particular alcohol flavorant-release composition have been found to show no significant loss in delivery of flavor. Other smoking tobacco products which are packaged therewith do not acquire the flavor of the flavorant which is contained in the alcohol flavorant-release composition, despite the absence of internal vapor barriers between the different flavored tobacco products.

6 Claims, No Drawings

UNITARY PACK OF SMOKING TOBACCO PRODUCTS CONTAINING POLYMERIC ALCOHOL FLAVORANT-RELEASE COMPOSITIONS

BACKGROUND OF THE INVENTION

The desirability of a unitary pack containing a choice of smoking tobacco products having different flavor notes is apparent. Unfortunately, due to the volatility and mobility of certain flavorants causing a transfer of the flavorant from one smoking tobacco product to another during processing and storage, such a single unit/dual or multiple choice pack has not been practicable.

Menthol, which is a flavorant commonly used and widely accepted as a flavorant for smoking tobacco products, shows a particularly high degree of volatility and mobility resulting in a transfer of menthol flavor from one tobacco product to another. In addition, the odor of menthol permeates most wrappers.

In order to reduce the volatility and mobility and the migration of menthol resulting therefrom, it has been suggested that menthol be incorporated into tobacco as part of a less volatile compound, which upon burning of the tobacco is decomposed to yield menthol.

For example, Bavley et al., U.S. Pat. No. 3,312,226 describes the incorporation of menthol into tobacco as the l-menthyl carbonate ester of various alcohols, such as linalool. These carbonate esters release menthol upon pyrolysis. However, these simple carbonate esters, like menthol itself, are somewhat susceptible to migration in tobacco and thus can impart a menthol flavor to unmentholated smoking tobacco products in the same pack. Additionally, the second alcohol of the carbonate ester can undergo chemical alteration during pyrolysis, resulting in undesired chemical fragments which can add a chemical aftertaste.

In Mold et al., U.S. Pat. No. 3,419,543 and 3,332,428, mixed carbonate esters of a flavorant, preferably menthol, and a polyhydroxy compound such as a monosaccharide, disaccharide, trisaccharide, polysaccharide, or glycol are described as a means for binding menthol in the tobacco in a relatively non-volatile form. Similarly, in Kallianos et al., U.S. Pat. No. 3,449,452, the incorporation of various other flavorants including vanillin and phenethyl alcohol, into tobacco in the form of relatively non-volatile mixed carbonarte esters of polyhydroxy compounds selected from the group consisting of mono-, di-, tri- and polysaccharides and glycols is described. However, since the alcohol linkages of these polyhydroxy compounds are only primary or secondary in character, the efficiency with which the flavorant can be regenerated upon pyrolysis is limited. In addition, when Mold menthol-release agents which would release a high proportion of menthol per unit weight were utilized, it was discovered that menthenes were often produced in addition to menthol, resulting in a bitter tasting tobacco smoke. Further, some of the Mold flavor-release agents are unstable to aging and have been found to steadily release menthol over a period of time.

The Rundberg, Jr., et al. U.S. Pat. No. 3,887,603 employs carbonate ester polymers for the controlled release of menthol. These menthol-release agents ae polymeric l-menthyl carbonate esters characterized by the presence of a pendant tertiary alcohol ester linkage thus making menthol release the preferred decomposition mechanism upon pyrolysis. These polymers lack substantial volatility and/or mobility at ambient temperature within a tobacco composition. Even these polymers, however, do not release menthol with the maximum efficiency.

Other methods for incorporating menthol and other flavorants into smoking tobacco products have also been described in U.S. Pat. Nos. 3,111,127, 3,126,012, 3,128,772, 3,139,888, 3,452,677, 3,580,259, 3,589,372, 3,625,224, 3,772,516, 3,750,674, 3,879,425, 3,881,025, 3,884,247, 3,890,981, 3,903,900, 3,914,451, 3,915,175, 3,920,027, 3,924,644, 3,937,288 and 3,943,943.

Nowhere, however, has there been described a flavorant-release composition which exhibits optimally efficient and uniform flavor-release characteristics while being sufficiently non-migratory to permit packaging of a smoking tobacco product containing the composition with other smoking tobacco products to which addition of the flavor of the composition is not desired. There has, thus, remained a need for improved flavorant-release composition for incorporation in smoking tobacco products which compositions would permit packaging of smoking tobacco products containing a flavorant with other smoking tobacco products without imparting the flavorant's taste to the latter products while upon pyrolysis uniformly and efficiently releasing the flavorant from the smoking product in which they are incorporated, without adding deleterious flavoring effect thereto.

Accordingly, it is the main object of this invention to provide a unitary pack of smoking tobacco products in which some of the smoking tobacco products are treated with a flavorant-release agent which is characterized by a substantial lack of volatility and/or mobility within a tobacco composition at ambient temperature, whereby, even after processing and storage, the untreated smoking tobacco products in the pack do not acquire the taste of the flavorant and the products containing the flavorant-release agent do not deliver significantly less flavor than smoking tobacco products treated with the flavorant itself.

It is a further object of the present invention to provide a unitary pack of smoking tobacco products in which a flavorant is incorporated in some of the smoking tobacco products as a polymeric alcohol flavorant-release carbonate ester resin which releases the alcohol flavorant when heated and does not have a deleterious effect on the flavor of the products.

It is another object of the present invention to provide a means for packaging flavored smoking tobacco products with smoking tobacco products which are unflavored or contain other flavorants without a transfer of flavorant between the smokin tobacco products while maintaining an optimally efficient release of flavorant upon normal smoking of the products thereby permitting the amounts of flavorant required to be added to a tobacco composition to be minimized.

Other objects and advantages of the present invention shall become apparent from the following description and examples.

SUMMARY OF THE INVENTION

This invention relates to a unitary pack of different flavored smoking tobacco products wherein some of the products contain an alcohol flavorant-release composition which delivers the flavor note of the alcohol upon pyrolysis. More particularly, the present invention comprises a unitary pack of smoking tobacco products in which a flavorant is incorporated into some of the products as a polymeric alcohol flavorant-release carbonate ester resin, the monomers of which have the general formula:

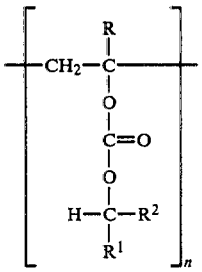

wherein R is a member selected from the group consisting of aliphatic, alicyclic, heterocyclic and aromatic hydrocarbon radicals; $R^1$ and $R_2$ are selected from hydrogen and aliphatic, alicyclic, heterocyclic and aromatic hydrocarbon radicals; and n is an integer which can vary between 2 and about 10,000. The remainder of the smoking tobacco products in the pack do not contain the flavorant which is contained in the alcohol flavorant-release composition.

The polymeric resins have a molecular weight between about 500 and 2,000,000 and decompose to yield the flavorant alcohol upon burning the tobacco. These polymers include α-substituted vinyl menthyl carbonate ester resin compositions such as poly(α-methylvinyl α-menthyl carbonate) and poly(α-styryl l-menthyl carbonate).

Smoking tobacco products which are treated with a particular flavorant-release composition have been found to show no significant reduction in delivery of the flavorant with aging. Other smoking tobacco products which are packaged therewith do not acquire the flavor note of the flavorant which is contained in the alcohol flavorant-release composition.

DETAILED DESCRIPTION OF THE INVENTION

In accordance with the present invention, a unitary pack of smoking tobacco products, for example, a pack of cigarettes, cigarillos, or cigars, is provided wherein a flavorant, which is incorporated in only some of the products, is not transferred to the other smoking tobacco products in the pack, despite the absence of internal vapor barriers between the different flavored tobacco products.

In accordance with the present invention, a smoking tobacco product containing a polymeric composition which releases a flavorant alcohol when heated is packaged in a unitary pack with other smoking tobacco products which do not contain this flavorant alcohol. The latter smoking tobacco products, which do not contain the alcohol flavorant-release resin, do not acquire the flavor note of the alcohol even after prolonged storage in the same pack.

The flavorant-release polymeric compositions which may be employed in the practice of the present invention are described and claimed in copending application Ser. No. 728,729 now U.S. Pat. No. 4,119,106. They are alcohol flavorant-release carbonate ester resin compositions having molecular weights in the range between about 500 and 2,000,000, preferably between about 1500 and 15,000, and consisting essentially of recurring monomer units corresponding to the formula:

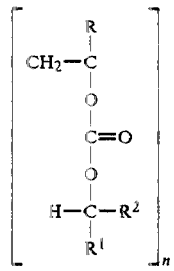

wherein R is a member selected from the group consisting of aliphatic, alicyclic, heterocyclic and aromatic hydrocarbon radicals containing between 1 and about 10 carbon atoms; $R^1$ and $R^2$ are members independently selected from the group consisting of hydrogen and aliphatic, alicyclic, heterocyclic and aromatic hydrocarbon radicals, and $R^1$ and $R^2$ taken together with the connecting elements form an alicyclic structure, and wherein the total number of carbon atoms in $R^1$ and $R^2$ collectively does not exceed about 20; and n is an integer which can vary between 2 and about 10,000, preferably between about 5 and 50.

In the formula above, preferred R substitutents are aliphatic radicals containing between 1 and about 6 carbon atoms, alicyclic radicals containing between about 3 and 10 carbon atoms and alkyl-substituted derivatives thereof, aromatic radicals containing between 6 and 10 carbon atoms and phenylalkyl radicals. It is highly preferred that the R radical be selected from lower alkyl and phenyl substituents.

$R^1$ and $R^2$ are preferably hydrogen or aliphatic radicals containing between 1 and about 6 carbon atoms, such as methyl, ethyl, propyl, isobutyl, pentyl, and the like. Preferred alicyclic $R^1$ and $R^2$ radicals are those containing between about 3 and 10 carbon atoms, and alkyl-substituted derivatives thereof. Preferred aromatic $R^1$ and $R_2$ radicals are those containing between 6 and about 10 carbon atoms and phenylalkyl radicals such as benzyl, phenylethyl, phenylpropyl, and the like. In an important embodiment, $R^1$ and $R^2$ taken together with the connecting elements form an alicyclic structure such as the menth-1-yl radical.

As is apparent, the R, $R^1$ and $R^2$ radicals described herein can include other elements in addition to hydrogen and carbon, e.g., oxygen and nitrogen. Such elements can be in the structural form of alkoxy, alkyleneoxy, carbonyl, carbalkoxy, amino, and the like, and in radical forms of heterocyclic structures such as pyrrole, imidazole, indole, pyridine, pyrazine, piperidine, piperazine, furan, pyran, morpholine, and the like. Preferred radicals of this type include:

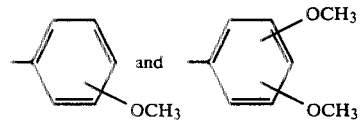

An interesting carbonate ester resin composition is one in which $R^1$ is ethyl and $R^2$ is the anisyl radical.

The polymeric alcohol flavorant-release carbonate ester resin compositions which are employed in the practice of the present invention are prepared by using conventional procedures for vinyl polymerization to polymerize an α-substituted vinyl carbonate ester having the formula:

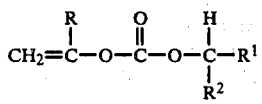

wherein R, $R^1$ and $R^2$ have the same definition as set forth above. These esters can be synthesized by treating a haloformate with an enolate in the following manner:

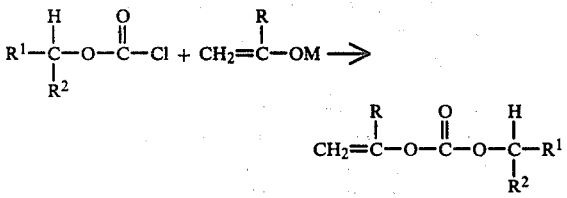

In a preferred synthesis, procedure, the enolate is prepared by treating a metal hydride (e.g., an alkali metal hydride) with an appropriate R radical substituted methyl ketone in a solvent at 0° C.:

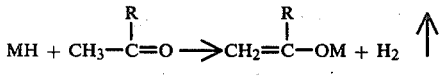

where M is alkali metal. In a second step, the enolate so prepared is added dropwise to a cooled solution of an appropriate chloroformate. Suitable solvents include benzene, toluene, dioxane, tetrahydrofuran, dimethoxyethane, and the like.

The chloroformate reactant can be prepared by the reaction of a selected alcohol and phosgene ($COCl_2$) at a temperature between about 5° C. and 35° C. in a solvent such as benzene, cyclopentane or ether. The phosgene is preferably added in substantial molar excess of the alcohol, and an appropriafte catalyst (e.g., pyridine or quinoline) can be employed in such an amount as to facilitate the reaction. The reaction mass is stirred for a total of about 3 hours and then allowed to stand overnight. At the end of this time, the desired chloroformate is usually recovered as a slightly yellow liquid.

Between about 0.001 and 10 weight percent, based on the weight of tobacco, of the polymeric alcohol flavorant-release agent, is admixed with natural or reconstituted tobacco to form a smoking tobacco composition. The alcohol flavorant-release polymer is incorporated into tobacco in accordance with methods known and used in the art of making a smoking tobacco composition. Preferably, the alcohol flavorant-release agent is dissolved in a solvent such as acetone or cyclohexane, and then sprayed on the tobacco or injected into the tobacco matrix. Such method ensures an even distribution of the flavorant-release agent throughout the tobacco, and thereby facilitates the production of a more uniform smoking tobacco composition, Alternatively, the alcohol flavorant-release carbonate ester resin composition can be admixed in solid form with the components of a reconstituted sheet of tobacco prior to the forming of the sheet.

The tobacco, with the alcohol flavorant-release composition incorporated therein, can then be formed into smoking tobacco products, such as cigarettes, according to conventional methods. A smoking tobacco product thus formed is then packaged, with other smoking tobacco products to which no alcohol flavorant or a different alcohol flavorant has been added. The pack so formed contains no internal vapor barriers between different flavored tobacco products and may be made according to methods known and used in the art. As used herein, unitary pack is intended to signify a pack in which there are not internal vapor barriers between types of tobacco products.

In an important embodiment, the polymeric alcohol flavorant release-carbonate ester resin, defined by the formula above the $R^1$ and $R^2$ taken together with the connecting elements forming the menth-1-yl radical, is incorporated into the tobacco of a cigarette and packaged with cigarettes containing no menthol flavorant. Illustrative of such polymer α-substituted vinyl menthyl carbonate resins are poly(α-methylvinyl l-menthyl carbonate) and poly(α-styryl l-menthyl carbonate).

The following examples are illustrative:

EXAMPLE 1

Preparation of α-Methylvinyl l-Menthyl Carbonate

Potassium hydride (0.5 mole, 81.0 g of 24.76% oil dispersion) was washed with anhydrous ethyl ether under nitrogen to remove the oil. After removal of the oil, 400 cc anhydrous tetrahydrofuran was added and the resulting suspension was stirred and cooled to 0° C. in an ice/salt bath. Acetone (0.5 mole, 29.0 g) was added dropwise to the stirred suspension such that the reaction temperature did not exceed 5° C. The reaction was complete when hydrogen evolution stopped. The resulting clear yellow solution was added to l-menthyl chloroformate (0.48 mole, 104.7 g) in 500 cc anhydrous tetrahydrofuran with stirring at 0° C. Addition was regulated such that the temperature did not exceed 5° C. After completion of addition, the reaction mixture was stirred for 24 hours at room temperature. The reaction was worked up by adding 1 liter of water and 300 cc of ethyl ether. The first water wash was back-extracted with three 100-cc portions of ethyl ether and all of the ether solutions were combined. The combined ether extracts were washed with four 1 liter portions of water. The ether solution was dried over anhydrous magnesium sulphate for 16 hours. After filtration and solvent evaporation, the resulting oil was distilled through a molecular still at 0.07 mm pressure and 125° C. skin temperature. A yield of 73.85 g (65.4%) was obtained.

Elemental Analysis: Found: C, 70.03, H, 10.46; Calc.: C, 69.96, H, 10.06.

EXAMPLE 2

Preparation of α-Styryl l-Menthyl Carbonate

Potassium hydride (0.095 mole, 15.36 g of a 24.76% oil dispersion) was placed in the upper vessel of a Grignard flask and washed with anhydrous ethyl ether to remove the oil. Freshly distilled dimethoxyethane (200 cc) was added and the resulting suspension was stirred with cooling by an ice/salt bath. Acetophenone (0.10 mole, 12.15 g) was added slowly such that the temperature did not rise above 9° C. The mixture was stirred for 1 hour after completion of addition and then was added slowly to l-menthyl chloroformate (0.095 mole, 20.8 g) in 100 cc of dimethoxyethane which had been maintained at 4° C. The addition was carried out such that the temperature did not rise above 11° C. The mixture was stirred and allowed to warm to room temperature overnight after completion of addition.

The reaction mixture was poured into 500 cc of water and extracted with three 200 cc portions of ethyl ether. The combined ethyl ether solutions were washed with 250 cc of water and subsequently with four 200 cc portions of water. The ether solution was dried over magnesium sulphate. After filtration and solvent evaporation, the residue obtained was purified by two molecular distillations. The first distillation was carried out at 78° C. skin temperature and 0.27 mm pressure. The residue obtained (19.35 g) was distilled again at 180° C. skin temperature and 0.01 mm pressure. A yield of 16.48 g (57.4%) was obtained.

Elemental Analysis: Found: C, 75.15; H, 8.70; Calc.: C, 75.46; H, 8.70.

EXAMPLE 3

Preparation of Poly(α-Methylvinyl l-Menthyl Carbonate)

α-Methylvinyl l-menthyl carbonate (71.00 g) was placed in a polymerization apparatus which was previously dried at 105° C. and allowed to cool under a positive pressure of dry nitrogen. Benzoyl peroxide (4.26 g) was added and the monomer/peroxide mixture was stirred with a stream of dry nitrogen introduced under the surface of the monomer for 30 minutes. The nitrogen stream was stopped and the apparatus was placed under a slight positive pressure with dry nitrogen and stirred and heated to 75° C. by a thermostated oil bath. The mixture was allowed to polymerize at 75° C. for 72 hours. After polymerization, the sample was allowed to cool to room temperature and a solid mass was obtained. The polymer mass was dissolved in 100 cc of dichloromethane and the solution was added slowly to 1.5 liters of methyl alcohol with vigorous stirring. A fine white precipitate which formed was filtered and was dried under reduced pressure (0.05 mm, 72 hours) at room temperature. A yield of 55.33 g of polymer (78.2%) was obtained.

Elemental Analysis: Found: C, 70.34; H, 10.15; Calc.: C, 69.96; H, 10.07.

EXAMPLE 4

Preparation of Poly(α-Styryl l-Menthyl Carbonate)

α-Styryl l-menthyl carbonate (8.02 g) and benzoyl peroxide (0.04 g) were placed in a round bottom flask and stirred with a stream of dry nitrogen introduced under the liquid surface for 3 hours. The nitrogen stream was stopped and the flask was placed under a slight positive pressure with dry nitrogen and was heated to 76° C. with stirring. The mixture was allowed to polymerize at 76° C. for 72 hours. After polymerization, the sample was allowed to cool to room temperature. The polymer was dissolved in 13 cc of dichloromethane and the solution obtained was added slowly to 300 cc of methyl alcohol with vigorous stirring. The fine white precipitate which formed was filtered and was dried under reduced pressure (0.05 mm, 16 hours) at room temperature. A yield of 2.31 g of polymer (28.8%) was obtained:

Elemental Analysis: Found: C, 70.34; H, 10.15; Calc.: C, 75.46; H, 8.67.

EXAMPLE 5

Preparation of Cigarettes Containing Poly (α-Methylvinyl Menthyl Carbonate)

Tobacco was sprayed with 1.74% of its own weight of poly(α-methylvinyl menthyl carbonate) in cyclohexane solution. After the solvent had evaporated, cigarette rods, 65 mm in length and containing about 0.78 g of tobacco were made by machine. Cellulose acetate filters, 20 mm in length, were attached by machine.

At the same time, control cigarettes, identical in all respects except for the absence of polymer, were prepared.

EXAMPLE 6

Preparation of Cigarettes Containing Poly(α-Styryl Menthyl Carbonate)

Tobacco was sprayed with 2.2% of its own weight of poly(α-styryl menthyl carbonate) in cyclohexane solution. Using the procedure set forth in Example 5, cigarettes were prepared.

EXAMPLE 7

Comparison of Menthol-Release Pyrolysis Data

A present invention composition, poly(α-styryl l-menthyl carbonate), and poly(1,1-dimethylallyl l-menthyl carbonate) in accordance with Rundberg et al. (U.S. Pat. No. 3,887,603), were subjected to pyrolysis conditions to compare the menthol-release properties of the two compositions.

Each composition was pyrolyzed in a quartz-tube with a helium flow to carry the pyrolysis products into a gas chromatographic analysis system.

| Polymer | Temperature of Maximum Release (°C.) | Percentage of Theoretically Available Menthol Release |
|---|---|---|
| Poly(α-styryl menthyl carbonate) | 200° | 90% |
| Poly(dimethylallyl l-menthyl carbonate) | 350° | 83.8% |

A comparison of results indicated that the present invention composition released a higher percentage of l-menthol flavorant at a lower temperaure than the Rundberg et al. composition.

EXAMPLE 8

Aging and Analysis of Cigarettes

Cigarettes containing poly(α-methylvinyl l-menthyl carbonate) and corresponding control cigarettes made in accordance with Example 5 were analyzed by standard procedures for menthol content in smoke.

Equal numbers of cigarettes containing the polymer and the control cigarettes were packaged in cigarette packs. These were then aged by holding them for 7 days at 110° F. and 15% relative humidity, followed by 4 days at 90° F. and 85% relative humidity, and then the entire cycle was repeated for a total of 22 days of accelerated aging. These cigarettes were then analyzed in the same manner as the fresh cigarettes.

The results are shown on Table 1.

Table 1

Menthol Delivery of Mixed Cigarettes Before and After Aging

| Cigarette Type | Menthol Delivery (mg/cigt) Fresh | Aged |
|---|---|---|
| Regular (Control) | 0.01 | <0.02 |

Table 1-continued

| Menthol Delivery of Mixed Cigarettes Before and After Aging | | |
|---|---|---|
| | Menthol Delivery (mg/cigt) | |
| Cigarette Type | Fresh | Aged |
| Menthol Release Polymer | 0.44 | 0.51 |

EXAMPLE 9

Preparation of 2-Phenylethyl Isopropenyl Carbonate (a) Potassium hydride dispersed in mineral oil (33.8 g total dispersion containing 23.79 weight-percent potassium hydride, 8.01 g, 0.20 mole) was washed under a nitrogen atmosphere with three 250 ml portions of pentane to remove mineral oil. The residual potassium hydride was suspended in 200 ml of anhydrous tetrahydrofuran. This suspension was cooled by means of an ice-salt bath, and a solution of 11.62 g (0.200 mole) of acetone in 200 ml of anhydrous tetrahydrofuran was added at such a rate that the temperature of the reaction mixture did not exceed 5° C. After addition, the reaction mixture was then stirred for 10 minutes.

(b) An aliquot (210 ml, 0.099 mole) of the solution described in part (a) above was added slowly to a solution of 17.55 g (0.095 mole) of 2-phenylethyl chloroformate in 150 ml of anhydrous tetrahydrofuran under a nitrogen atmosphere with stirring and cooling by means of a salt-ice bath. During the addition the temperature of the reactants did not exceed 10° C. Cooling was removed, and the reaction mixture was allowed to warm to ambient temperature and to stir for about 18 hours. The 250 ml of diethyl ether was added, and the mixture was washed successively with one 300-ml portion of water, two 400-ml portions of quarter-saturated aqeuous sodium chloride solution, and finally one 400-ml portion of water. The ether layer was separated and dried over magnesium sulfate. Removal of the solvent provided a residue weighing 18.83 g, which on distillation through a rotary thin film molecular still at 100° C. skin temperature and 0.09–0.10 mm pressure gave 10.21 g (52.1%) and 2-phenylethyl isopropenyl carbonate as a colorless liquid. Spectral data confirmed the identity of the compound.

EXAMPLE 10

Preparation of Poly(21-Phenylethyl Isopropenyl Carbonate)

2-Phenylethyl isopropenyl carbonate (4.0 g) and 0.12 g of benzoyl peroxide were warmed together at 75° C. for 48 hours with stirring under a nitrogen atmosphere. The cooled reaction mixture was dissolved in 5 ml of methylene chloride, and this solution was added slowly to 100 ml of methanol with rapid stirring. A tacky, oily solid agglomerated. This was dissolved again in 5 ml of methylene chloride, and re-precipitated in 100 ml of methanol. A total of three precipitations gave after drying at 0.05 mm and ambient temperature for 48 hours 2.35 g (58.8%) of poly(2-phenylethyl isopropenyl carbonate). The polymer was identified by spectral means.

When heated, a sample of the polymer liberated the odor of 2-phenylethanol.

EXAMPLE 11

Aging and Analysis of Cigarettes

Cigarettes are flavored with an acetone solution of 50 ppm (based on the weight of filler) of poly(2-phenylethyl isopropenyl carbonate) prepared according to Example 10. After exposure to air at room temperature and 65% rh for several days to remove the acetone, these cigarettes (equipped with 20 mm cellulose acetate filters) are packaged with an equal number of similar cigarettes not containing the polymer. The package is subjected to an accelerated storage cycle as described in Example 8. When the cigarettes are removed and smoked, those containing the polymer deliver the distinctive honey-like flavor of the unaged cigarettes; those not treated with the polymer do not have this flavor note.

What is claimed is:

1. A unitary pack of smoking tobacco products which comprises at least one smoking tobacco product which contains an alcohol flavorant-release composition as hereinafter defined in a unitary pack with at least one smoking tobacco product which does not contain such alcohol flavorant-release composition, said alcohol flavorant-release composition being a polymeric composition having a molecular weight in the range between about 500 and 2,000,000 and consisting essentially of recurring monomer units corresponding to the formula:

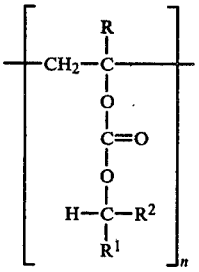

wherein R is a member selected from the group consisting of aliphatic, alicyclic and aromatic hydrocarbon radicals containing between 1 and about 10 carbon atoms, $R^1$ and $R^2$ are members independently selected from the group consisting of hydrogen and aliphatic, alicyclic, heterocyclic and aromatic hydrocarbon radicals, or $R^1$ and $R^2$ taken together with the connecting elements form an alicyclic structure, and wherein the total number of carbon atoms in $R^1$ and $R^2$ collectively does not exceed about 20; and n is an integer between 2 and about 10,000.

2. The pack of claim 1 wherein the polymeric composition has the formula:

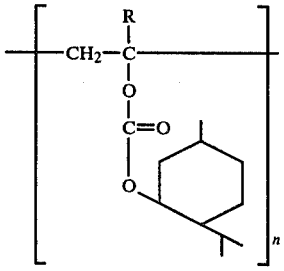

wherein the structural representation

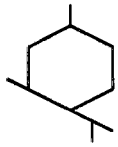

denotes the menth-1-yl radical.

3. The pack of claim 1 wherein the polymeric composition is poly(α-styryl l-menthyl carbonate).

4. The pack of claim 1 wherein the polymeric compositionis poly(α-methylvinyl l-menthyl carbonate).

5. The pack of claim 1 wherein the polymeric composition has a molecular weight between about 1500 and 15,000.

6. The pack of claim 1 wherein for the polymeric composition n is between about 5 and 50.

* * * * *

UNITED STATES PATENT AND TRADEMARK OFFICE

CERTIFICATE OF CORRECTION

PATENT NO. : 4,212,310

DATED : July 15, 1980

INVENTOR(S) : THOMAS V. VAN AUKEN, HARVEY J. GRUBBS, and WILLIAM R. JOHNSON, JR.

It is certified that error appears in the above-identified patent and that said Letters Patent are hereby corrected as shown below:

In the Abstract, lines 8-9 below the structure, "poly(α-methylvinylα-menthyl carbonate) and poly(α-styryl α-menthyl carbonate)," should read --poly(α-methylvinyl l-menthyl carbonate) and poly(α-styryl l-menthyl carbonate),--.

Column 1, line 39, "No." should read --Nos.--.

Column 1, line 48, "carbonarte" should read --carbonate--.

Column 1, line 65, "ae" should read --are--.

Column 2, line 29, "effect" should read --effects--.

Column 2, line 54, "smokin" should read --smoking--.

Column 3, line 33, "α-menthyl carbonate)" should read -- l-menthyl carbonate)--.

Column 3, line 58, "The" should read --These--.

Column 4, line 43, "$R^1$ and $R_2$" should read --$R^1$ and $R^2$--.

Column 5, line 43, "appropriafte" should read --appropriate--.

Column 5, line 55, "of" should read --for--.

Column 6, line 10, "not" should read --no--.

UNITED STATES PATENT AND TRADEMARK OFFICE

CERTIFICATE OF CORRECTION

PATENT NO. : 4,212,310

DATED : July 15, 1980

INVENTOR(S) : THOMAS V. VAN AUKEN, HARVEY J. GRUBBS, and WILLIAM R. JOHNSON, JR.

It is certified that error appears in the above-identified patent and that said Letters Patent are hereby corrected as shown below:

Column 6, line 14, "the" should read --with--.

Column 6, line 18, "polymer" should read --polymeric--.

Column 7, line 63, "70.34; H, 10.15; Calc.:" should read --75.62; H, 8.54; Calc.:--.

Column 9, line 42, "and" should read --of--.

Column 9, line 47, "Poly(21-Phenylethyl" should read --Poly(2-Phenylethyl--.

Column 12, lines 3-4, "compositionis" should read --composition is--.

Signed and Sealed this

*Twenty-eighth* Day of *October 1980*

[SEAL]

*Attest:*

*Attesting Officer*

SIDNEY A. DIAMOND

*Commissioner of Patents and Trademar*